US010539152B2

(12) United States Patent
Springer et al.

(10) Patent No.: US 10,539,152 B2
(45) Date of Patent: Jan. 21, 2020

(54) FAN FRAME AND FAN MODULE

(71) Applicant: Brose Fahrzeugteile GmbH & Co. Kommanditgesellschaft, Wuerzburg, Wuerzburg (DE)

(72) Inventors: Nils Springer, Oldenburg (DE); Thomas Dreesen, Oldenburg (DE); Antje Findeisen, Oldenburg (DE)

(73) Assignee: BROSE FAHRZEUGTEILE GMBH & CO. KOMMANDITGESELLSCHAFT, WUERZBERG, Wuerzburg (DE)

( * ) Notice: Subject to any disclaimer, the term of this patent is extended or adjusted under 35 U.S.C. 154(b) by 509 days.

(21) Appl. No.: 14/774,349

(22) PCT Filed: Mar. 11, 2014

(86) PCT No.: PCT/EP2014/054700

§ 371 (c)(1),
(2) Date: Sep. 10, 2015

(87) PCT Pub. No.: WO2014/140012

PCT Pub. Date: Sep. 18, 2014

(65) Prior Publication Data

US 2016/0017893 A1 Jan. 21, 2016

(30) Foreign Application Priority Data

Mar. 11, 2013 (DE) ..... 10 2013 204 069

(51) Int. Cl.
*F04D 29/52* (2006.01)
*F01P 5/02* (2006.01)
(Continued)

(52) U.S. Cl.
CPC ..... *F04D 29/522* (2013.01); *F01P 1/06* (2013.01); *F01P 5/02* (2013.01); *F01P 11/10* (2013.01);
(Continued)

(58) Field of Classification Search
CPC .... F04D 29/522; F04D 19/002; F04D 25/166; F01P 1/06; F01P 5/02; F01P 11/10; F01P 2005/025
(Continued)

(56) References Cited

U.S. PATENT DOCUMENTS 5,277,547 A * 1/1994 Washizu ..... F01P 5/06 165/122
5,901,672 A * 5/1999 Suzuki ..... B60K 11/04 123/41.49
(Continued)

FOREIGN PATENT DOCUMENTS

CN 101363356 A 2/2009
CN 103133412 A 6/2013
(Continued)

OTHER PUBLICATIONS

International Search Report for PCT Application No. PCT/EP2014/054700, dated Aug. 12, 2014, 5 pages.
(Continued)

*Primary Examiner* — Mark A Laurenzi
*Assistant Examiner* — Kelsey L Stanek
(74) *Attorney, Agent, or Firm* — Westman, Champlin & Koehler, P.A.

(57) ABSTRACT

The present invention relates to a fan frame for a plurality of fan modules, particularly for a radiator of a motor vehicle, comprising a first fan holder having a first outflow region, at least one further fan holder having a further outflow region, and an intermediate region that connects adjoining edge regions of the first and the further fan holders to each other. The fan frame is characterised in that a shielding device, which separates the first and a further outflow region from each other, is provided in the intermediate region. The present invention further relates to a fan module, particularly having such a fan frame.

13 Claims, 5 Drawing Sheets

(51) Int. Cl.
*F01P 11/10* (2006.01)
*F01P 1/06* (2006.01)
*F04D 19/00* (2006.01)

(52) U.S. Cl.
CPC ..... *F04D 19/002* (2013.01); *F01P 2005/025* (2013.01)

(58) Field of Classification Search
USPC ..... 415/60, 220
See application file for complete search history.

(56) References Cited

U.S. PATENT DOCUMENTS

| | | | | |
|---|---|---|---|---|
| 6,401,801 | B1 | 6/2002 | Dicke | |
| 6,491,502 | B2 * | 12/2002 | Hunt | F04D 29/582 415/119 |
| 7,640,897 | B2 | 1/2010 | Gandrud et al. | |
| 8,291,721 | B2 * | 10/2012 | Stauter | B60H 1/3229 62/239 |
| 8,946,951 | B2 | 2/2015 | Mahfoudh et al. | |
| 2009/0038564 | A1 | 2/2009 | Gandrud et al. | |
| 2009/0129918 | A1 | 5/2009 | Takeuchi et al. | |
| 2013/0093292 | A1 | 4/2013 | Mahfoudh et al. | |

FOREIGN PATENT DOCUMENTS

| | | | | |
|---|---|---|---|---|
| DE | 102 57 838 | A1 | 7/2004 | |
| DE | 103 21 732 | A1 | 12/2004 | |
| DE | 10 2004 034 733 | A1 | 2/2006 | |
| DE | 10 2006 062 116 | A1 | 6/2007 | |
| DE | 10 2008 037 146 | A1 | 4/2009 | |
| DE | 10 2008 063 922 | A1 | 7/2009 | |
| DE | 10 2008 024 978 | A1 | 11/2009 | |
| DE | 10 2008 041 236 | A1 | 2/2010 | |
| DE | 10 2010 024 978 | A1 | 12/2011 | |
| DE | 102010024978 | A1 * | 12/2011 | F01P 1/06 |

OTHER PUBLICATIONS

German Search Report for German Patent Application No. 10 2013 204 069.5, dated Oct. 18, 2013, 8 pages.
Copy of Office Action, including Search Report, for Chinese Patent Application No. 201480013951.0, dated Feb. 3, 2017, 10 pages.

* cited by examiner

FAN FRAME AND FAN MODULE

CROSS-REFERENCE TO RELATED APPLICATION

This Application is a Section 371 National Stage Application of International Application No. PCT/EP2014/054700, filed 11 Mar. 2014 and published as WO 2014/140012 on 18 Sep. 2014, in German, the contents of which are hereby incorporated by reference in their entirety.

FIELD OF THE INVENTION

The present invention relates to a fan frame for a plurality of fan modules. The invention further relates to a fan module.

TECHNICAL BACKGROUND

Although the present invention is described with reference to a fan module for a motor vehicle, it is not limited thereto, but can also be applied to other technical fields.

A fan module in a motor vehicle is used for thermal management. The fan module is generally provided on a radiator or heat exchanger in order to transport an air flow through the radiator and to thus ensure sufficient cooling, for example in stop-and-go traffic, if there is not a sufficient airstream.

A fan module typically comprises an externally driven fan or ventilator which usually conveys and compresses air by means of an impeller which rotates in a frame.

In order to ensure optimal utilisation of the radiator surface in substantially rectangular or non-square radiators, double-fan modules are sometimes used which comprise at least two fans. The structure and operation of such double-fan modules are for example described in DE 10 2004 034 733 A1, DE 10 2008 041 236 A1 and DE 102 57 838 A1.

A double-fan module often comprises one larger and one smaller fan. Furthermore, a fan frame is provided in most cases, in which the fans are mounted beside each other in a compact manner.

In parallel operation using both fans, in double-fan modules a higher level of noise generation may occur, and users usually find this unpleasant, which reduces the level of comfort. Two different designs are known to the applicant for the outflow region of the fans, and these have different effects on noise generation and air output.

A first design which is known to the applicant provides a completely open structure of the outflow region of the entire double-fan module. Therefore, the outflow is influenced as little as possible. However, in this case the outflows from the two fans may interfere with each other, and this may again result in undesired noise generation.

Another design which is known to the applicant provides that the outflow region of each individual fan of the double-fan module is completely surrounded, in a manner similar to a tube fan. By completely surrounding the fan, the air output (volume- or mass flow of the air) is reduced, however, since the outflow to the side is restricted.

SUMMARY OF THE INVENTION

In this context, the problem addressed by the present invention is to provide an improved fan frame and an improved double-fan module.

According to the invention, this problem is solved by a fan frame having the features of claim 1 and/or by a double-fan module having the features of claim 10.

The following is accordingly provided:

A fan frame for a plurality of fan modules, in particular for a radiator of a motor vehicle, comprising a first fan bracket, which has a first outflow region, comprising at least one additional fan bracket, which has an additional outflow region, comprising an intermediate region, which interconnects adjacent edge regions of the first and the additional fan brackets, wherein a shielding device is provided in the intermediate region and separates the first outflow region and an additional outflow region from each other.

A fan module, in particular a double-fan module, in particular for a radiator of a motor vehicle, comprising a fan frame, comprising a first fan which is mounted in the fan frame and is designed to generate a first air flow, comprising at least one additional fan which is mounted in the fan frame, is designed to generate an additional air flow and is arranged and mounted in the fan frame beside the first fan, wherein a shielding device is provided in an intermediate region of the fan frame provided between the first and the additional fan in respective outflow regions of the first and/or the additional fan in order to separate the first air flow from the additional air flow.

The concept underlying the present invention consists in providing part of the circumference of the fan with a shielding device. This part of the circumference of the fan is preferably located in the outflow region, that is to say on the discharge side or the side of the fan frame facing away from the intake side, between the first and the additional fan. An influence of the flows in the outflow region of the first and the additional fan is effectively prevented or at least reduced to a minimum by means of said shielding device, whereby the noise generation when the first and the additional fan are operated simultaneously is also significantly reduced. Furthermore, the entirety of the remaining side face remains free for the outflow. Using the solution according to the invention, the first and the additional fan of the fan module can thus be advantageously operated with minimal noise generation and without having to take into account losses in the air output.

The present invention is preferably used in a double-fan module. For example, according to the invention a web region of the outlet ring of a second, small fan may be formed in the region between the first, large fan and the second fan so as to be raised relative to the rest of the region. This web region thus forms a separating web. The same can equally be provided for two fans of the same size and/or for additional fans.

According to the invention, the fan flow of the small fan can be prevented from being influenced by the fan flows of the large fan without having the drawbacks of an outlet ring, which is continuous overall, on the small fan. Therefore, according to the invention, a reduction in the tonal noises which may otherwise be caused primarily by the small fan can be achieved. This is advantageously carried out without overly greatly limiting the air output capacity, that is to say without additionally impeding the outflow.

Advantageous embodiments and developments emerge from the additional dependent claims and from the description with reference to the figures of the drawings.

In a preferred embodiment, the shielding device is designed as a partition portion which can be inserted into the fan frame. This partition portion or separating web can also be retrofitted to said frame, that is to say after production of the frame. In addition, the partition portion or separating web can be inserted for example using a suitable fit. Optionally or additionally, it can also be glued into place or clipped in. Therefore, the partition portion or separating web may also be retrofitted to existing fan frames. Alternatively, variants with and without the separating web can be produced during production, without changing the injection moulds for the fan frame, for example.

In an alternative embodiment, the shielding device is designed as a partition portion which is integrally formed with the fan frame. Therefore, the partition portion or separating web can be formed when the fan frame is originally moulded, in particular injection moulded. The separating portion thus does not have to be attached in an additional operating step, which simplifies production.

According to another embodiment, the partition portion has a profiled upper edge. The upper edge is the edge which completes the partition portion or separating web on the outflow side. Said edge may for example be toothed or corrugated or profiled in another manner.

According to a preferred embodiment, the partition portion extends around the first and/or additional fan bracket in the intermediate region over an angular segment of from 10° to 135°, in particular of from 30° to 60°. In advantageous embodiments, the angle is 40° to 50°. In this case, the fan shaft is provided as a reference axis, and is arranged in the centre of the bond when the fan is installed. Preferably, the partition portion is rounded in portions and extends in an arc-shaped manner along the angular segment in portions. It forms a cylindrical lateral-surface portion in this case. Alternatively, the partition portion may however also have another design and shape, for example having straight or angular portions. According to the invention, the partition portion extends in the region in which the first and the additional outflow region come close to each other. As a result, flows in the outflow regions are prevented from negatively influencing each other.

According to another preferred embodiment, the partition portion extends over a circumference of the first and/or additional fan bracket over an arc segment in the range of from 5 cm to 25 cm, in particular in the range of from 8 cm to 15 cm. In advantageous embodiments, the arc segment is 10-12 cm. The arc segment denotes the projected length of the partition portion which can be measured as the length of the partition portion in an arc portion, taking the fan shaft as the centre. It should be noted here that owing to contours, for example angular portions or the like, this length does not have to correspond to the actual length of the partition portion. The arc portion is only used as a simplified measurement. Because the partition portion extends over a circumference of the first and/or the additional bracket over such an arc segment, sufficient shielding and/or separation of the first and the additional outflow region is achieved.

According to another preferred embodiment, the partition portion is arranged between two attachment struts of the first or additional fan bracket. The space which is left free between two attachment struts is referred to as a pocket. The attachment struts have a certain height in the region in which they are connected to the frame. Therefore, a free surface, which forms a pocket, is produced between the attachment struts in this connection region. In a preferred development of this embodiment, two attachment struts are arranged such that they are each positioned on an end of the intermediate region of the frame. The partition portion is then arranged in the pocket between said attachment struts. In other embodiments, other pockets or a plurality of pockets between attachment struts may also be provided with a partition portion.

In another preferred embodiment, the partition portion extends over up to at least 50%, in particular up to 70% to 100%, of an axial height of the attachment struts. The axial height is measured in parallel with the fan shaft and may be 2 cm to 5 cm, for example. In particularly preferred embodiments, the height of the attachment struts is 2.5 cm to 3 cm. Therefore, the partition portion has a height which is sufficient to shield the first and the additional outflow region from each other.

In other preferred embodiments, the fan frame is designed as a plastics injection-moulded part. In this case, the entire fan frame is preferably formed in one piece. Multiple-part embodiments are also conceivable, however.

In a preferred embodiment of a fan module, the fan frame according to the invention is designed according to the above-described embodiments.

In other preferred embodiments, the shielding device is designed as a partition portion which extends in the outflow direction of the first and/or the additional air flow. This partition portion or separating web preferably extends as an elevation in the axial direction of the fan. Here, all the embodiments which are described with reference to the fan frame are possible for the fan module.

In a particularly preferred embodiment, the first fan has a greater diameter than the additional fan. Therefore, different operating modes of the fan module are possible. If such a fan module is designed as a double-fan module, it can be operated in three different operating modes: only using the smaller fan, only using the larger fan or using both fans. In the typical operating mode, the double-fan module is operated using both fans, for example if a relatively high cooling capacity is required.

In other preferred embodiments, the first fan has a higher driving power and/or air output than the additional fan. This may be provided as an alternative to or in addition to a different diameter of the fans.

The above embodiments and developments can be combined in any conceivable manner, as long as this is reasonable. Further possible embodiments, developments and uses of the invention also include combinations of features of the invention described previously or below with respect to the embodiments, even if not explicitly stated. In this context, a person skilled in the art will more particularly also add individual aspects as improvements or additions to the respective basic form of the present invention.

CONTENT OF THE DRAWINGS

The present invention is explained below in greater detail on the basis of the embodiments specified in the schematic figures of the drawings, in which.

The accompanying figures of the drawings are intended to convey further understanding of the embodiments of the invention. They show embodiments and, in conjunction with the description, clarify principles and concepts behind the invention. Other embodiments and many of the advantages mentioned become apparent with reference to the drawings. The elements of the drawings are not necessarily shown to scale in relation to each other.

In the figures of the drawings, the same elements, features and components, and those serving the same function and having the same effect, are provided with the same reference signs in each case, unless specified otherwise.

DESCRIPTION OF EMBODIMENTS

Figure 1:
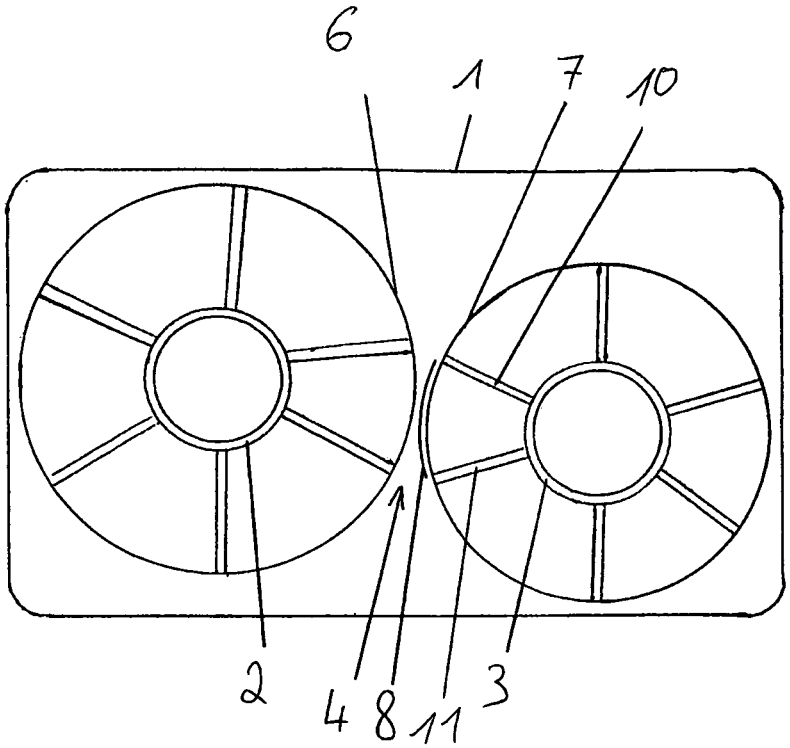
FIG. 1 is a schematic view of a fan frame according to the invention.

FIG. 1 is a schematic view of a fan frame 1 according to the invention. Said frame comprises a first bracket 2 and an additional, preferably second, bracket 3, which are each designed to mount a fan in the fan frame 1. The brackets 2, 3 each have an edge region 6, 7 and attachment struts 10, 11. The attachment struts 10, 11 open into a retaining ring, which is designed for attaching a fan. An intermediate region 4 which interconnects the edge regions 6, 7 is provided in the frame 1 between the two brackets 2, 3.

The fan frame 1 has two sides, namely an intake side and a discharge side, FIG. 1 showing the discharge side. Said frame is provided such that a fan which is installed in the brackets 2 and 3 discharges the air it takes in on this side. In the figure, the respective outflow regions of the brackets 2 and 3 can thus be seen. A shielding device 8 is provided in the intermediate region 4 between the two brackets 2 and 3. Said shielding device is arranged and designed such that the outflow region of the second bracket 3 is shielded from the outflow region of the first bracket 2.

Figure 2:
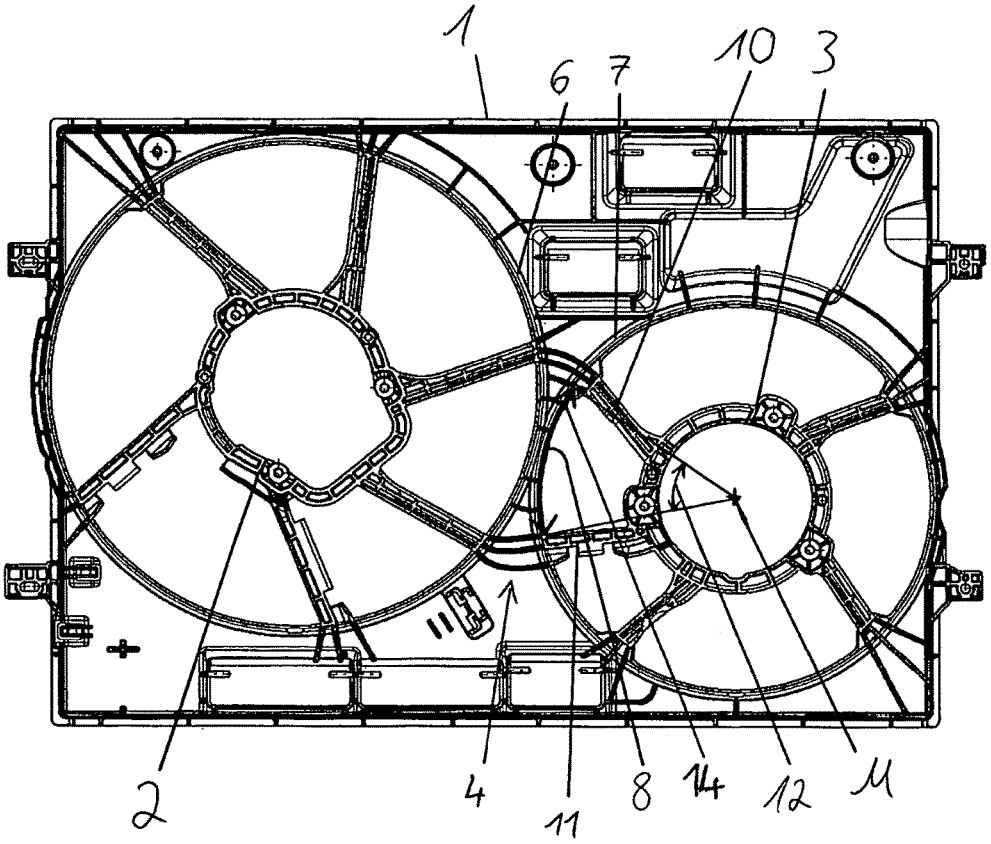
FIG. 2 shows a detailed embodiment of a fan frame according to the invention.

FIG. 2 shows an embodiment of a fan frame 1 according to the invention, the basic design corresponding to the description of the fan frame 1 shown in FIG. 1. In this embodiment, the partition portion 8 is arranged in the region between two struts 10 and 11 of the second bracket 3. The second bracket 3 is designed to receive a smaller fan, while the first bracket 2 is designed to receive a larger fan. This is explained in greater detail with reference to FIG. 5.

The second bracket 3 has a central point M, through which a shaft of a fan (not shown) of a fan module which is installed in the bracket would extend into the drawing plane. Based on this shaft, the partition portion or a raised separating web extends over an angular segment 12, which in the embodiment shown has an angle of 45°. The partition portion extends between the two struts 10 and 11 substantially over an arc segment of 10 cm, for example. Owing to the geometry of the attachment struts, in this case an ideal shape for the arc or for the cylindrical lateral-surface portion is not described by the partition portion. Instead, the actual shape is provided in portions with angular portions or recesses in order to adapt to the shape of the attachment struts 10, 11 and to attach thereto.

Figure 3A:
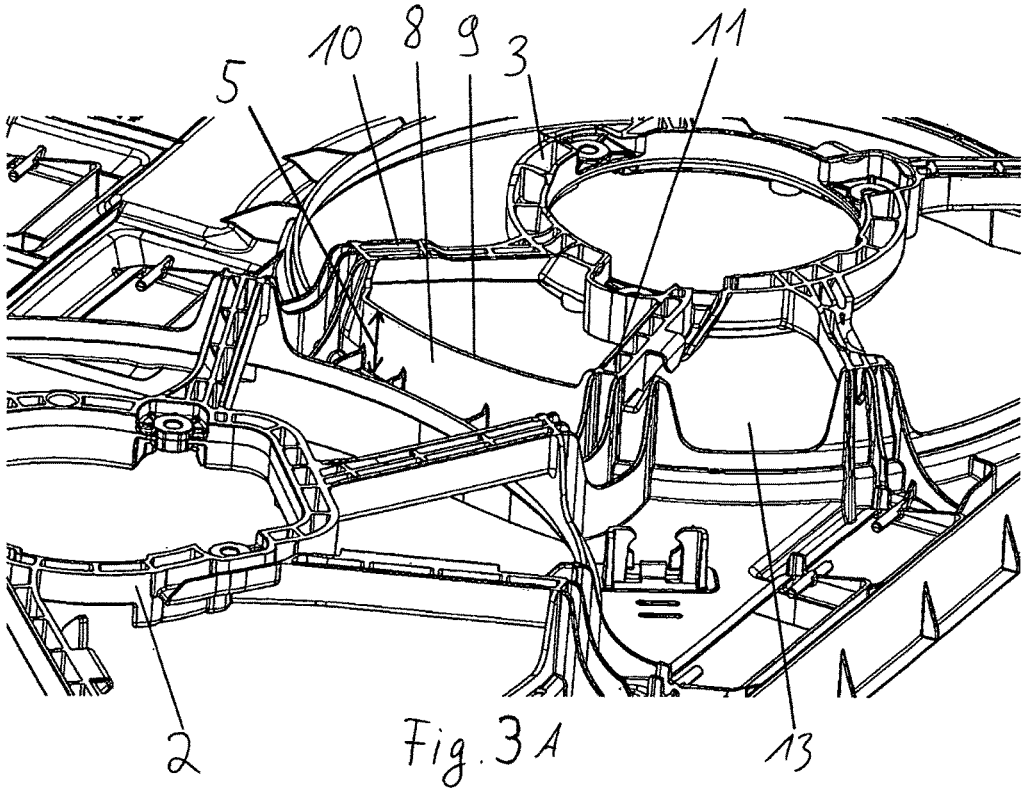
FIGS. 3A and 3B are perspective views of a detail of the fan frame from FIG. 2 having different partition portions.
Figure 3B:
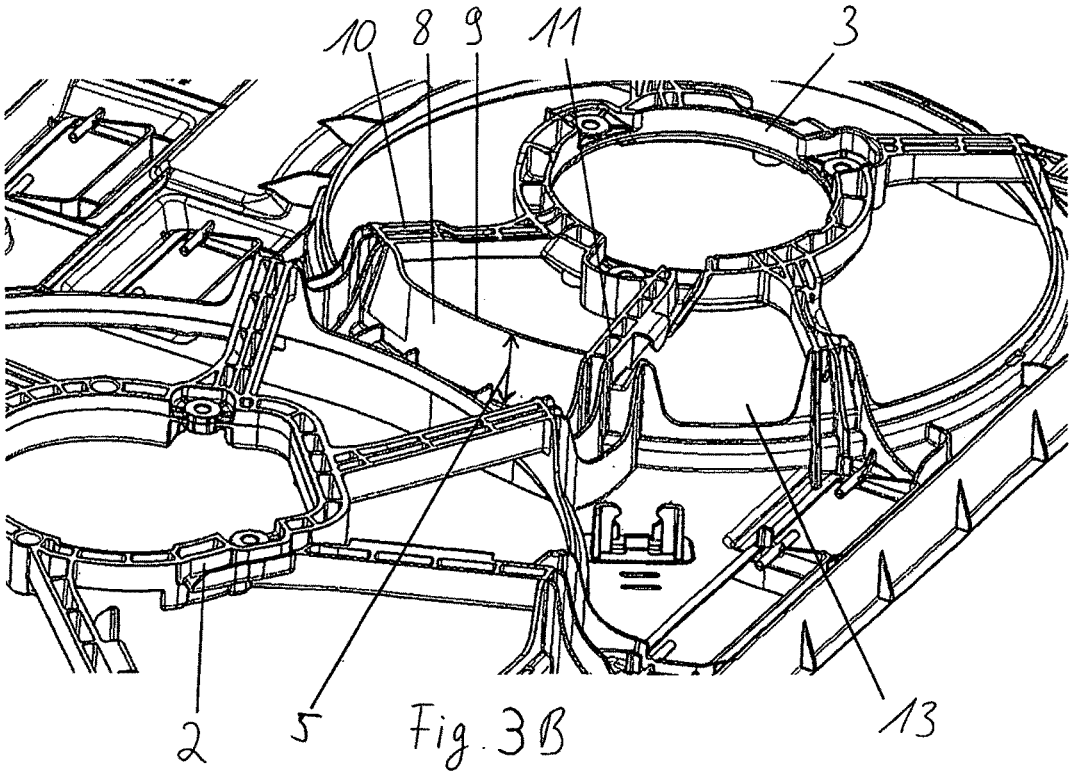

FIGS. 3A and 3B are each perspective views of a detail of a fan frame 1 according to FIG. 2. FIGS. 3A and 3B show different embodiments of a partition portion 8.

In FIG. 3A, the partition portion 8 extends between the two attachment struts 10 and 11, the partition portion 8 having a height 5 which corresponds to 70% of the height of the attachment struts 10 and 11. This height is sufficient to sufficiently shield the outflow region of the second bracket 3, which corresponds in the view in FIGS. 3A and 3B to the side of the brackets shown, from the outflow region of the first bracket 2. Therefore, flows emerging in the outflow regions cannot be negatively influenced before they reach a radiator or heat exchanger of a motor vehicle, for example.

The region between two attachment struts is referred to as a pocket if a partition portion is not provided therein. Therefore, in the embodiment shown, the pocket between the attachment struts 10 and 11 is filled by the partition portion 8. In alternative embodiments, a plurality of pockets 13 between additional attachment struts of the bracket 3 may also be filled with a partition portion.

Furthermore, alternatively to the embodiment shown, it would also be conceivable for the pockets of the first bracket 2 to be designed to have a partition portion 8. Similarly to the embodiment shown, said portion would preferably be provided in the intermediate region 4.

FIG. 3B shows the same detail as FIG. 3A, but here an alternative partition portion 8 is provided. Said portion has a height 5 which corresponds to 100% of the height of the attachment struts 10 and 11. Therefore, the partition portion 8 extends over the entire height of the discharge side of the fan frame.

In the embodiments shown in FIGS. 3A and 3B, the partition portion 8 is in each case integrally formed with the fan frame. Here, the fan frame is preferably formed as a plastics injection-moulded part.

In alternative embodiments, the partition portion may be provided as a separate part which can be inserted into the fan frame. In addition, it may for example be inserted into a recess in the fan frame using a suitable fit. Alternatively or additionally, the partition portion can also be clipped in or glued into place.

Figures 4A, 4B, 4C, 4D, 4E, 4F:
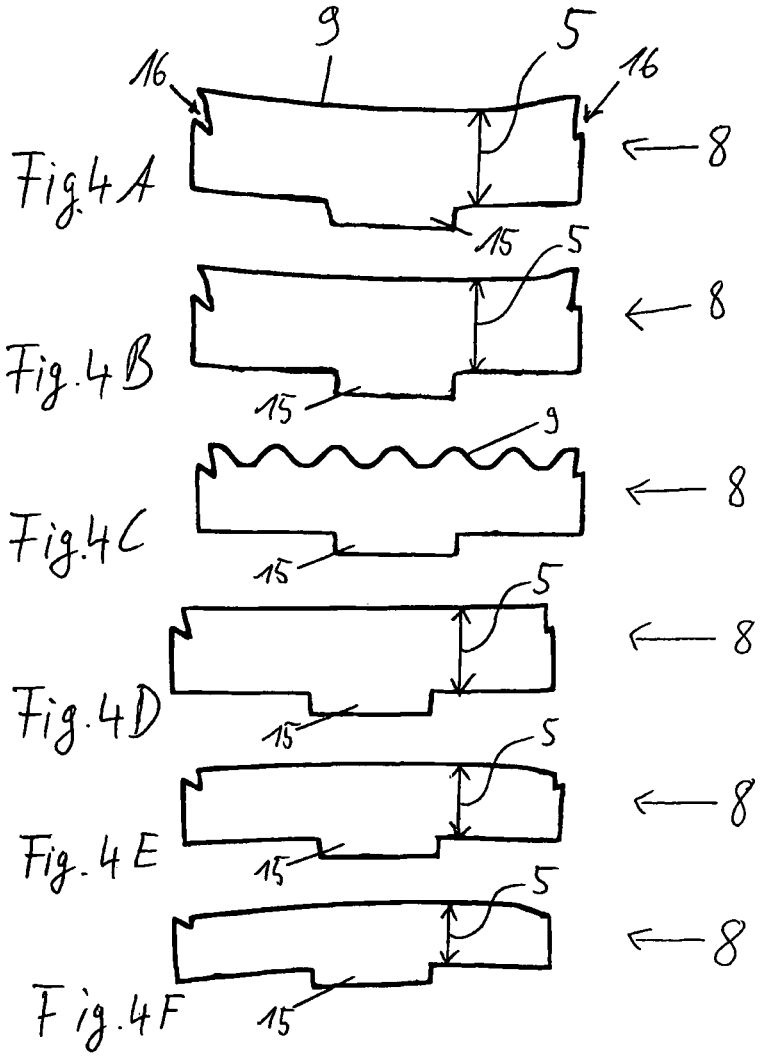
FIG. 4A-4F show examples of different shapes of the partition portions.

FIG. 4 shows different examples of a partition portion 8. All of the partition portions 8 shown are provided as insertable partition portions. Said portions comprise an insertion extension 15, by means of which they can be inserted into a recess in the fan frame 1. Furthermore, lateral recesses 16 are provided, which are provided to fit and/or anchor the partition portion to the attachment struts 10, 11. FIGS. 4A, 4B and 4D to 4F each show a partition portion having a planar upper edge 9, which only has slight differences from a shape of an arc or a cylindrical lateral-surface portion according to the shape of the intermediate region 4 and of the attachment struts 10, 11. FIG. 4A to 4F are each plan views of the radial inner surface of the partition portion 8.

The partition portion 8 according to FIG. 4A has a height 5 which corresponds to 100% of the height of the attachment struts 10, 11. This height is 2.8 cm, for example. This value may of course significantly differ therefrom, depending on the design and the available installation space in a fan module. For example, the height 5 of the attachment struts 10, 11 is between 2 cm and 5 cm.

The partition portion 8 according to FIG. 4B has a slightly reduced height 5 of approximately 95% of the height of the attachment struts 10, 11.

FIG. 4C shows an embodiment of a partition portion 8 having a profiled upper edge 9. In this embodiment, the upper edge 9 is corrugated. Alternatively, the upper edge may also be toothed or may have a contour having square recesses or another type of profiling.

FIG. 4D again shows a partition portion 8 having a planar upper edge, a further reduced height 5 of 90% of the height of the attachment struts 10, 11 being provided. In FIG. 4E the height 5 is reduced to 80% and in FIG. 4F the height is reduced to 70% of the height of the attachment struts 10, 11.

Figure 5:
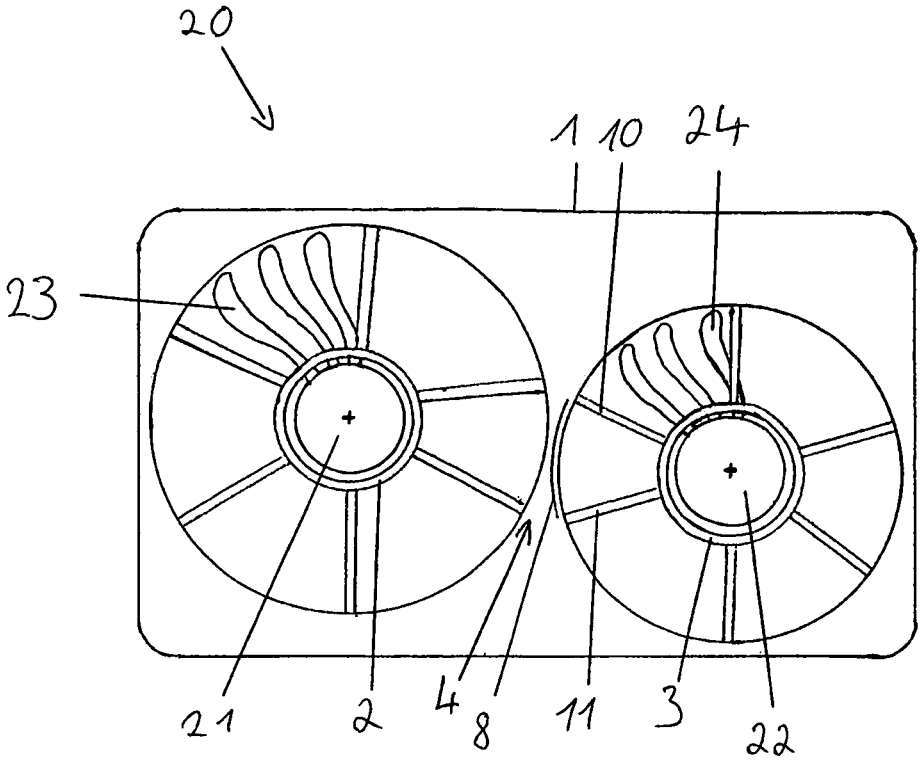
FIG. 5 is a schematic view of a double-fan module according to the invention.

FIG. 5 is a schematic view of a double-fan module 20. Said module comprises a fan frame 1 according to FIG. 1. The structure of the fan module 20 is of course transferrable to the embodiment of a fan frame 1 which is shown in FIG. 2.

In the first bracket 2, a first, large fan 21 is provided, the fan blades 23 of which are distributed over the entire circumference of the fan 21. In the view in FIG. 5, the fan blades 23 are shown schematically in just one portion of the fan circumference for the sake of greater clarity. In the additional, preferably second, bracket 3, an additional, preferably second, smaller fan 22 is mounted, of which the impeller blades 24 are also only shown schematically.

The double-fan module 20 is provided for mounting on a rectangular radiator or heat exchanger, which in particular is of a rectangular shape which has a different length and width and preferably corresponds to the rectangular shape of the frame 1. Therefore, the radiator or heat exchanger can be supplied with cooling air in three different operating modes, with high utilisation of the radiator surface. In the operating mode using both fans 21, 22, the shielding device 8 which is provided in the outflow region of the fans 21, 22 in the intermediate region of the fan frame 1 separates an air flow generated by the first fan 21 in the outflow region thereof from an air flow generated by the second fan 22 in the outflow region thereof. Therefore, the two air flows do not negatively influence each other, because they do not get in the way of each other owing to the separation by means of the shielding device 8. Furthermore, the first fan 21 preferably has a greater diameter than the second fan 22, and also has a higher driving power and air output than the second fan 22.

Although the present invention has been fully described above on the basis of preferred embodiments, it is not limited thereto, but rather may be modified in a number of ways.

Therefore, the heights of the attachment struts and thus also the height of the partition portion should always be adapted to the installation space which is available for the double-fan module, that is to say that the heights of the attachment struts and of the partition portion can also be (considerably) lower or (considerably) higher.

The length of the partition portion can of course be varied depending on the dimensions of the double-fan module and of the fan diameter, that is to say shorter and longer lengths of the partition portion, which are adapted to such dimensions, are also possible.

The values given should also only be understood to be advantageous, and should not limit the invention to that effect.

Although the invention has been explained with reference to a double-fan module, such a fan module and thus the associated frame may also contain or receive more than two fans. In this case, the invention is not limited to double-fan modules, but rather the term double-fan module should be understood in the sense of a multi-fan module.

LIST OF REFERENCE SIGNS

1 Fan frame
2, 3 Bracket
4 Intermediate region
5 Height of the partition portion
6, 7 Edge region
8 Shielding device, partition portion
9 Edge surface
10, 11 Attachment struts
12 Angular segment
13 Pocket
14 Arc segment
20 (Double-) fan module
21, 22 Fan
23, 24 Fan blades
M Central point

The invention claimed is:

1. A fan frame for a plurality of fan modules,
comprising a first fan bracket, which has a first outflow region,
comprising at least one additional fan bracket, which has an additional outflow region,
comprising an intermediate region, which continually interconnects adjacent edge regions of the first and the additional fan brackets,
wherein a shielding device is provided in the intermediate region and separates the first outflow region and the additional outflow region from each other, wherein the shielding device is designed as a partition portion which is integrally formed with the fan frame and arranged between two attachment struts of the first or additional fan bracket, wherein the partition portion extends up to 70% to 100% of an axial height of the attachment struts, and wherein the partition portion extends around at least one of the first and additional fan brackets in the intermediate region over an angular segment from 10°-135°.

2. The fan frame of claim 1, wherein
the partition portion has a profiled upper edge.

3. The fan frame of claim 1, wherein
the partition portion extends around at least one of the fan brackets in the intermediate region over an angular segment of 30° to 60°.

4. The fan frame of claim 1, wherein
the partition portion extends over a circumference of at least one of the brackets over an arc segment in the range of from 5 cm to 20 cm or in the range of from 8 cm to 15 cm or in the range of from 10 cm to 12 cm.

5. The fan frame of claim 1, wherein
the partition portion extends over at least 50% of an axial height of the attachment struts.

6. The fan frame of claim 1, wherein
the fan frame is designed as a plastics injection-moulded part.

7. The fan frame of claim 1, wherein the fan frame is designed to be used for a radiator of a motor vehicle.

8. A fan module for a radiator of a motor vehicle,
comprising a fan frame comprising a first fan bracket, at least one additional fan bracket, and an intermediate region of the fan frame, which continually separates the first fan bracket from the at least one additional fan bracket,
comprising a first fan which is mounted in the fan frame and is designed to generate a first air flow,
comprising at least one additional fan which is mounted in the fan frame, is designed to generate an additional air flow and is arranged and mounted in the fan frame beside the first fan,
wherein a shielding device is provided in the intermediate region of the fan frame between the first and the additional fan in respective outflow regions of at least one of the first and the additional fan in order to separate the first air flow from the additional air flow, wherein the shielding device is designed as a partition portion which is integrally formed with the fan frame and arranged between two attachment struts of the first or additional fan bracket, wherein the partition portion extends up to 70% to 100% of an axial height of the attachment struts, and wherein the partition portion extends around at least one of the first and additional fan brackets in the intermediate region over an angular segment from 10°-135°.

9. The fan module of claim 8, wherein the first fan bracket has a first outflow region;

the least one additional fan bracket having the respective additional outflow region; and the intermediate region interconnects adjacent edge regions of the first and the additional fan brackets, wherein the shielding device is provided in the intermediate region and separates the first outflow region and the respective additional outflow region from each other.

10. The fan module of claim 8, wherein the partition portion extends in the outflow direction of the first or the additional air flow.

11. The fan module of claim 8, wherein the first fan has a greater diameter than the additional fan.

12. The fan module of claim 8, wherein the first fan has at least one of a higher driving power and a higher air output than the additional fan.

13. The fan module of claim 8, wherein the fan module is designed as a double fan module.

* * * * *